US006948342B2

(12) United States Patent
Houston et al.

(10) Patent No.: US 6,948,342 B2
(45) Date of Patent: Sep. 27, 2005

(54) CIRCULAR KNITTING MACHINE

(75) Inventors: Darrell B. Houston, Hickory, NC (US); Allan L. Bolick, Lenoir, NC (US); Donald K. Burns, Newton, NC (US)

(73) Assignee: Houston Hosiery Mills, Inc., Valdese, NC (US)

( * ) Notice: Subject to any disclaimer, the term of this patent is extended or adjusted under 35 U.S.C. 154(b) by 439 days.

(21) Appl. No.: 10/150,749

(22) Filed: May 17, 2002

(65) Prior Publication Data

US 2004/0261462 A1 Dec. 30, 2004

(51) Int. Cl.[7] ..... D04B 9/38
(52) U.S. Cl. ..... 66/25; 66/8
(58) Field of Search ..... 66/8, 13, 17–29

(56) References Cited

U.S. PATENT DOCUMENTS 3,576,115 A * 4/1971 Schmidt ..... 66/17
3,835,668 A * 9/1974 Schoebel et al. ..... 66/17
3,930,383 A * 1/1976 Nuber ..... 66/17
5,577,397 A * 11/1996 Iida ..... 66/8
5,613,375 A 3/1997 Renda et al. ..... 66/8
5,657,648 A 8/1997 Ives et al. ..... 66/193
5,924,309 A * 7/1999 Conti ..... 66/17
6,151,921 A * 11/2000 Plath ..... 66/17

* cited by examiner

*Primary Examiner*—Danny Worrell
(74) *Attorney, Agent, or Firm*—MacCord Mason PLLC

(57) ABSTRACT

A circular knitting machine. The apparatus includes: a knitting cylinder; a bed for supporting the knitting cylinder; a plurality of cam blocks; a dial or double cylinder for forming a rib stitch; and a reduced height cam for forming a tuck stitch on the cylinder needle. Also, in the preferred embodiment, the present invention includes an actuator for selectively disengaging the second feed needle clearing cam. The present invention also includes a rib knit, tubular article having at least two rib stitches per cylinder stitch section.

17 Claims, 7 Drawing Sheets

CIRCULAR KNITTING MACHINE

BACKGROUND OF THE INVENTION (1) Field of the Invention

The present invention relates generally to circular knitting machines and, more particularly, to a circular knitting machine for knitting a rib-knit tubular article, such as a sock, which has significantly increased cross-stretch.

(2) Description of the Prior Art

Socks are usually made on cylinder sized knitting machines generally in 3–5 inch cylinder width category. These machines produce socks which provide very good fit in the foot, but do not provide adequate cross-stretch in the ankle and leg portion for individuals who have larger calves or specific medical needs. The mid-calf sock found in the prior art is very difficult for individuals with large calves to wear. Specifically, if the sock fit in the foot portion, generally the top portion for the larger calved person was much too tight. Thus, the prior art socks did not have a significant amount of cross-stretch, so that the wider girth calf would become a very uncomfortable fit.

Another area of difficulty in prior art was how the standard sock may fit a diabetic. Diabetics tend to have significant foot problems and having a sock that fits well and is comfortable in the foot, ankle and the leg portion is extremely important to a diabetic. The sock needs to be non-binding, but it also needs to stay up and not fall and end up at the ankles. Specifically, diabetics require socks with very loose ankle and leg portions because significant compression in those areas is very painful for diabetics who normally have very sensitive skin. Standard socks, if they are loose enough in the ankle and calf area to be comfortable, tend to fall down and not stay up on the calf. If they stayed up, they tended to be too tight in the body of the sock and the compression caused by the elasticity of the sock was painful to the diabetic.

For diabetics, it is necessary that socks fit particularly well in the foot area and have sufficient elasticity in the ankle and leg area, so that they stay up without causing excess compression and stress against the ankle and leg. In dress socks, in the mid-calf length, it is necessary that the sock fit the foot and has sufficient elasticity to stay up above the calf without unnecessary binding and without excess fabric. This is particularly true in mid-calf socks for persons with larger than average calves.

There is a need therefore to provide adequate and comfortably fitting socks for diabetics without causing any binding or pressure in the ankle or leg portion of the sock. It is also necessary in the mid-calf dress sock design that the mid-calf sock comfortably fits the foot and at the same time has sufficient elasticity to fit the ankle and the larger than average calf without binding and having excess fabric. However, conventional circular knitting machines are unable to create a stitch with the necessary variation in stretch.

Thus, there remains a need for a new and improved circular knitting machine for knitting a rib-knit tubular article, such as a sock, which includes means for knitting a tuck stitch on the cylinder needle to provide significantly increased cross-stretch while, at the same time, includes means for preventing the fabric from snagging on the needles.

SUMMARY OF THE INVENTION

The present invention is directed to a circular knitting machine. The apparatus includes: a knitting cylinder; a bed for supporting the knitting cylinder; a plurality of cam blocks; means for forming a rib stitch; and means for forming a tuck stitch on the cylinder needle. In the preferred embodiment, the means for forming the cylinder tuck stitch includes: means for lowering the second feed clear cam; and a fabric separator for preventing the fabric from snagging on the needles. Also, in the preferred embodiment, the present invention includes means for selectively disengaging the second feed needle clearing cam.

In the preferred embodiment, the means for lowering the second feed clear cam include reduction of the cam height. Also, the fabric separator may include an air blast directed at the fabric, which may be selectively activated. Alternatively, the fabric separator may include increased angle separation between an empty needle and the stitch formation. Preferably, the increased angle is greater than about 20 degrees. Also, the means for forming a tuck stitch on a cylinder needle may be either a single revolution or the apparatus may skip a revolution.

The means for selectively disengaging the second feed needle clearing cam may further include a second feed needle clearing cam and an actuator connected to the second feed needle clearing cam. In the preferred embodiment, the actuator includes a rod connected to the drum of the knitting machine.

The knitting cylinder may further include at least two feed cams or further includes multiples of two (e.g. 4, 6, etc.). The plurality of cam blocks form the cylinder tuck stitch. The means for forming the rib stitch is a dial or a double cylinder.

The present invention also includes a rib knit, tubular article. In the preferred embodiment, the knitted tubular article includes: at least two rib stitches per cylinder stitch section. In the preferred embodiment, the cylinder section further includes a flat knit section.

The flat knit section may further include a foot including a heel, instep, a sole and a toe. The flat knit section may further include a cushioned portion, wherein the cushion portion includes a full cushion portion, a half cushion portion or a random cushion selection.

In the preferred embodiment, the knitted tubular article also includes one rib per cylinder per stitch section. The rib stitches per cylinder stitch section further include cross stretching greater than about 130%. Also, the rib stitches per cylinder stitch section further include length stretch, which is substantially the same as one to one.

Accordingly, one aspect of the present invention is to provide a circular knitting machine. The apparatus includes: a knitting cylinder; a bed for supporting the knitting cylinder; a plurality of cam blocks; means for forming a rib stitch; and means for forming a tuck stitch on the cylinder needle.

Another aspect of the present invention is to provide in a circular knitting machine, the apparatus including: a knitting cylinder; a bed for supporting the knitting cylinder; a plurality of cam blocks; and means for forming a rib stitch the improvement comprising: means for forming a tuck stitch on the cylinder needle, the means including: means for lowering the second feed clear cam; and a fabric separator for preventing the fabric from snagging on the needles.

Still another aspect of the present invention is to provide a circular knitting machine. The apparatus includes: a knitting cylinder; a bed for supporting the knitting cylinder; a plurality of cam blocks; means for forming a rib stitch; means for forming a tuck stitch on the cylinder needle, the means including: (i) means for lowering the second feed clear cam; and (ii) a fabric separator for preventing the fabric from snagging on the needles; and means for selectively disengaging the second feed needle clearing cam.

Still one more aspect of the present invention is to provide a rib knit, tubular article. The knitted tubular article includes: at least two rib stitches per cylinder stitch section; one rib per cylinder per stitch section; and a flat knit section.

These and other aspects of the present invention will become apparent to those skilled in the art after a reading of the following description of the preferred embodiment when considered with the drawings.

DESCRIPTION OF THE PREFERRED EMBODIMENTS

Figure 1:
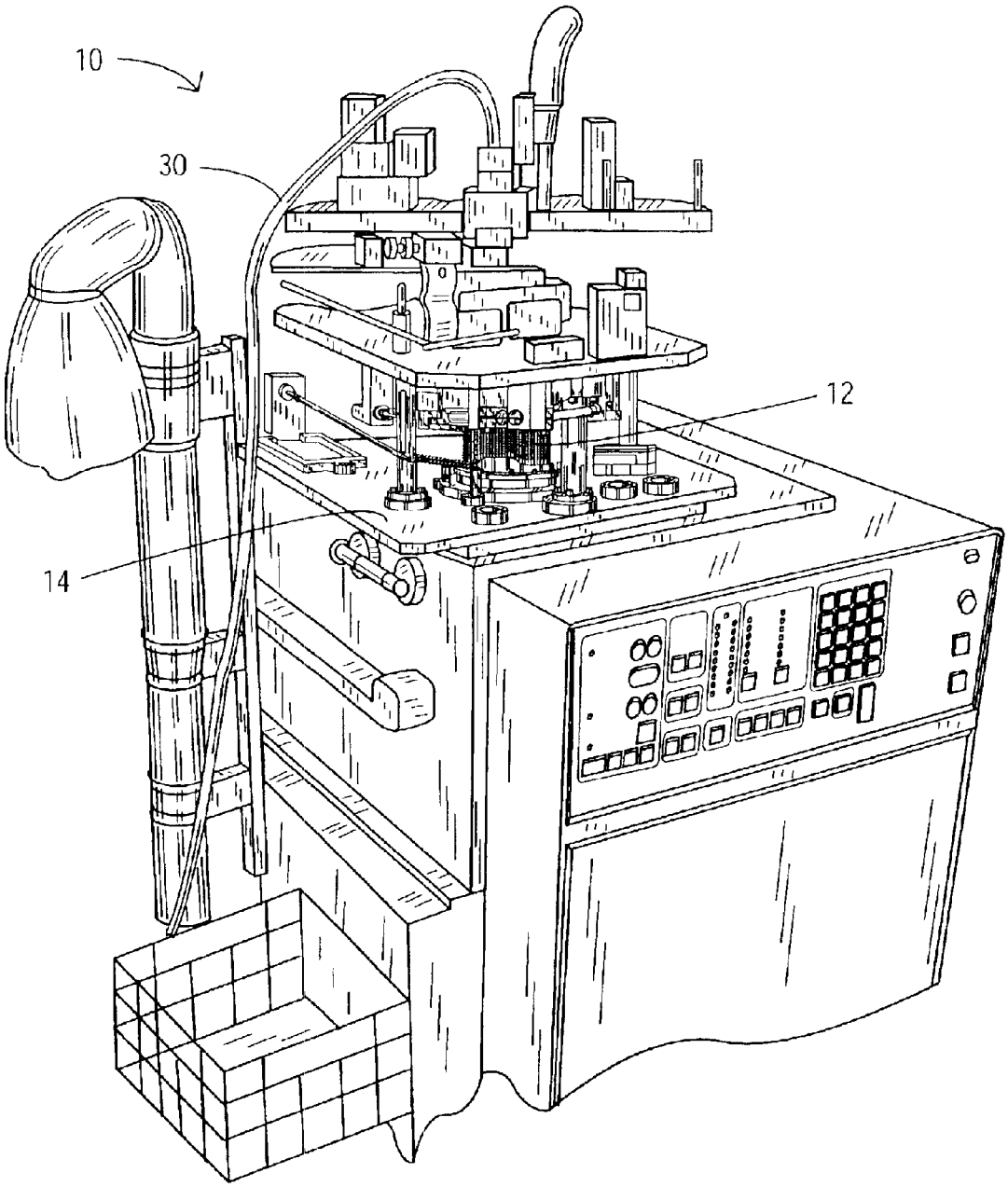
FIG. 1 is a perspective view of a circular knitting machine constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
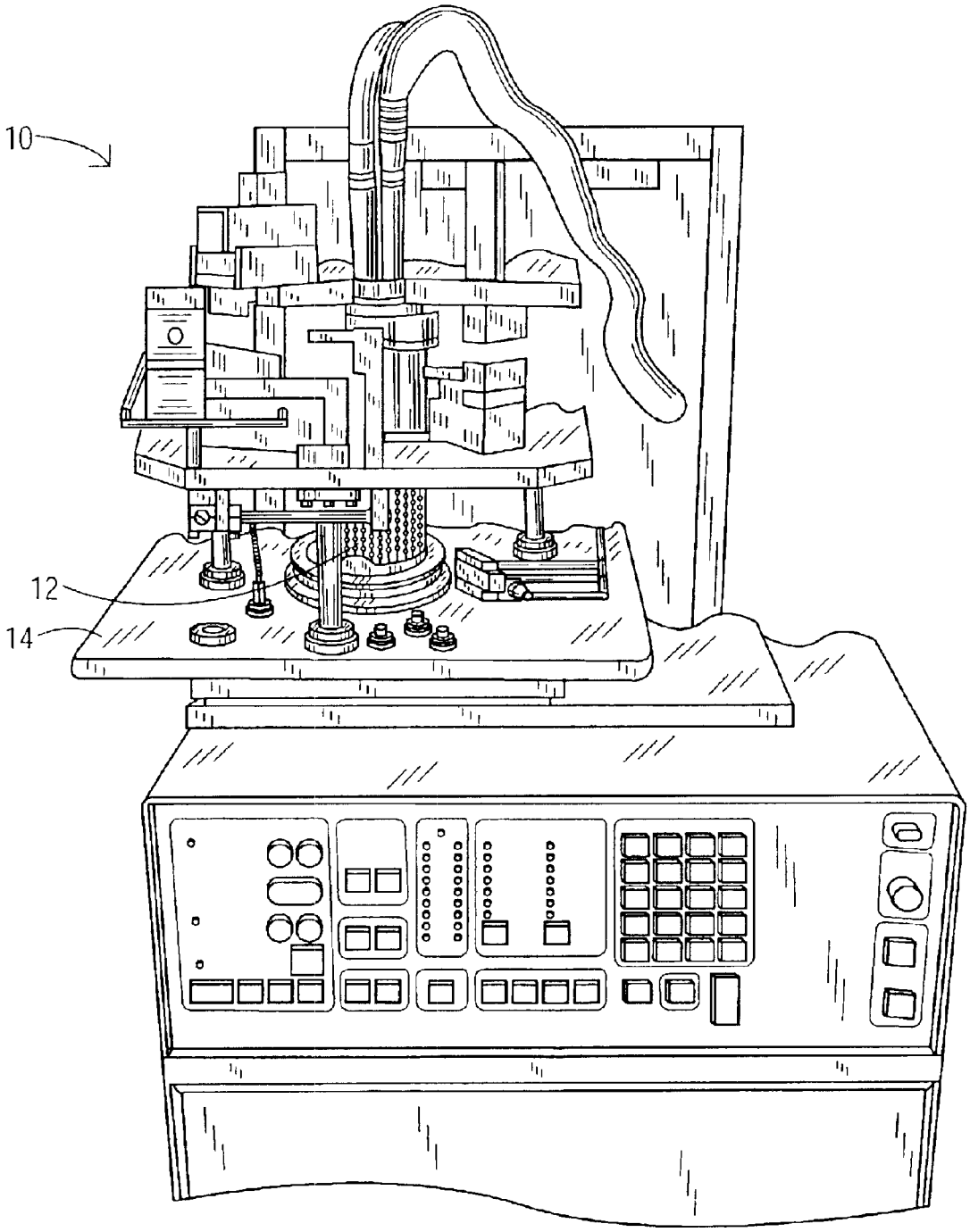
FIG. 2 is a front elevational view of the apparatus as shown in FIG. 1.

Referring now to the drawings in general and FIG. 1 in particular, it will be understood that the illustrations are for the purpose of describing a preferred embodiment of the invention and are not intended to limit the invention thereto. As best seen in FIGS. 1 and 2, a circular knitting machine, generally designated 10, is shown constructed according to the present invention. The circular knitting machine 10 includes the major sub-assemblies as follows: a creel (not shown), a knitting cylinder 12, a bed for supporting the knitting cylinder 14, a plurality of cam blocks 16, a means for forming the rib stitch 20, and a plurality of needles (not shown).

According to the present invention, a circular knitting machine utilized to knit hosiery, in particular rib knit socks, is modified to produce a special stitch which provides for cross-stretch in the fabric which is greater than 130% of the fabric, while at the same time, providing virtually no stretch in the length of the fabric. The cross-stretch elasticity provided by the modified circular knitting machine 10 has unique application in rib knit tubular articles, in particular, socks.

Knitting cylinder 12 contains at least two feed cams. These feed cams are included within the knitting cylinder 10 in multiples of two (e.g. 4, 6, etc.). The knitting cylinder 12 also contains a plurality of cam blocks 16.

Figure 3:
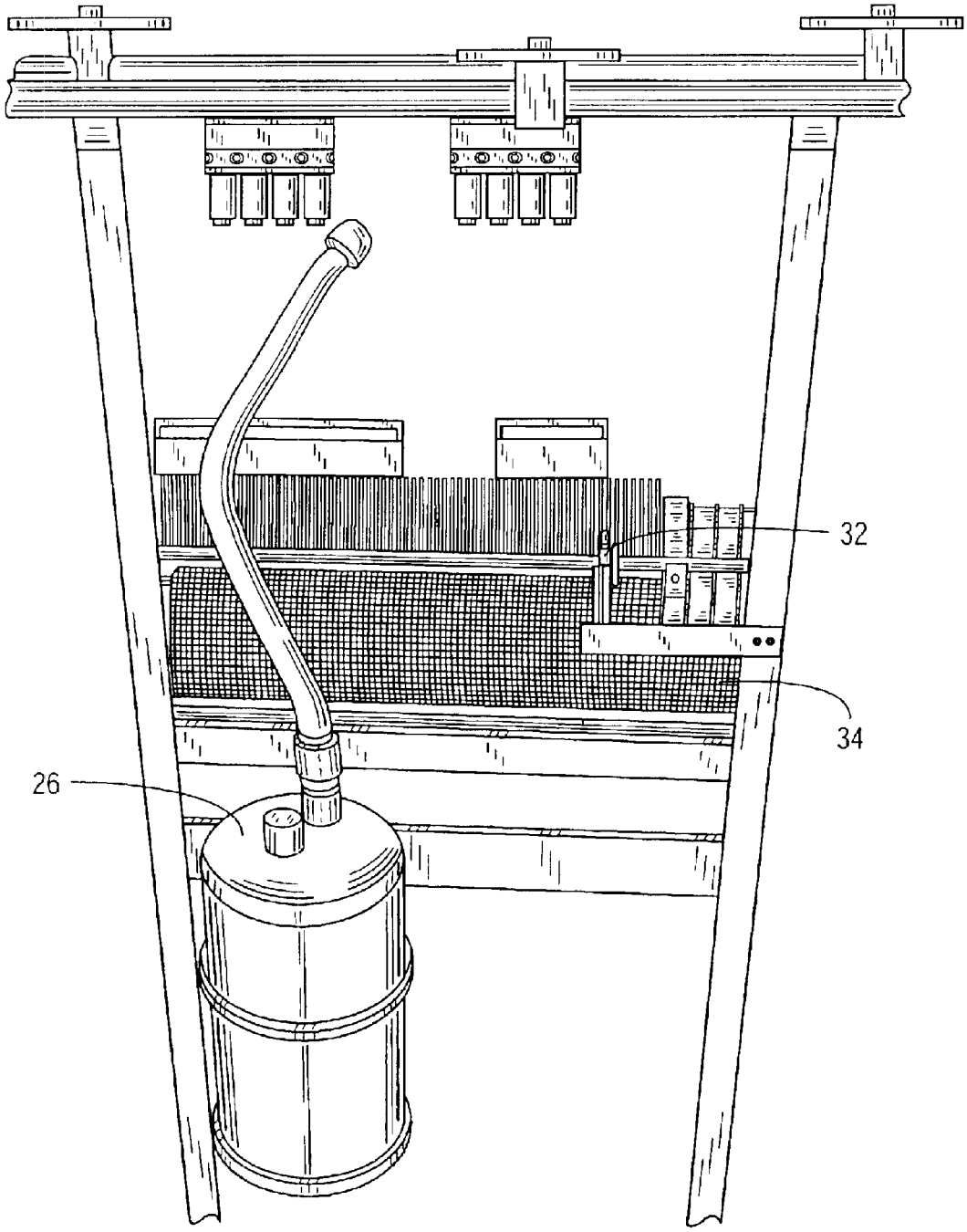
FIG. 3 is a rear elevational view of the apparatus as shown in FIG. 1.
Figure 4:
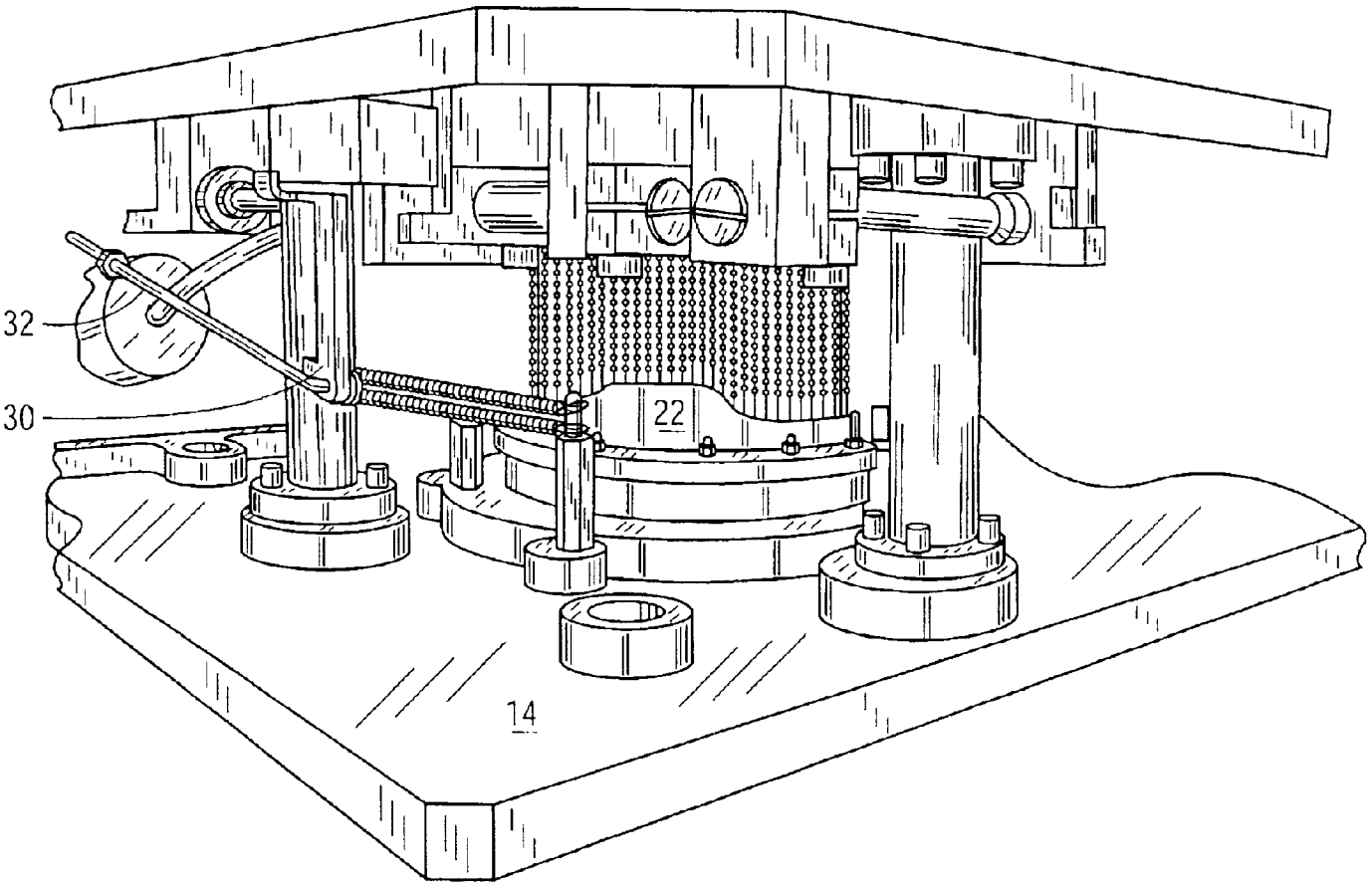
FIG. 4 is an enlarged perspective view of the reduced cam height.

Referring to FIGS. 3 and 4, a means for selectively disengaging a second feed needle clearing cam 26 and a second feed needle clearing cam 30 are shown. The second feed needle clearing cam 30 also includes an actuator comprising a rod connector 32 connected to drum 34 of the knitting machine.

Figure 5:
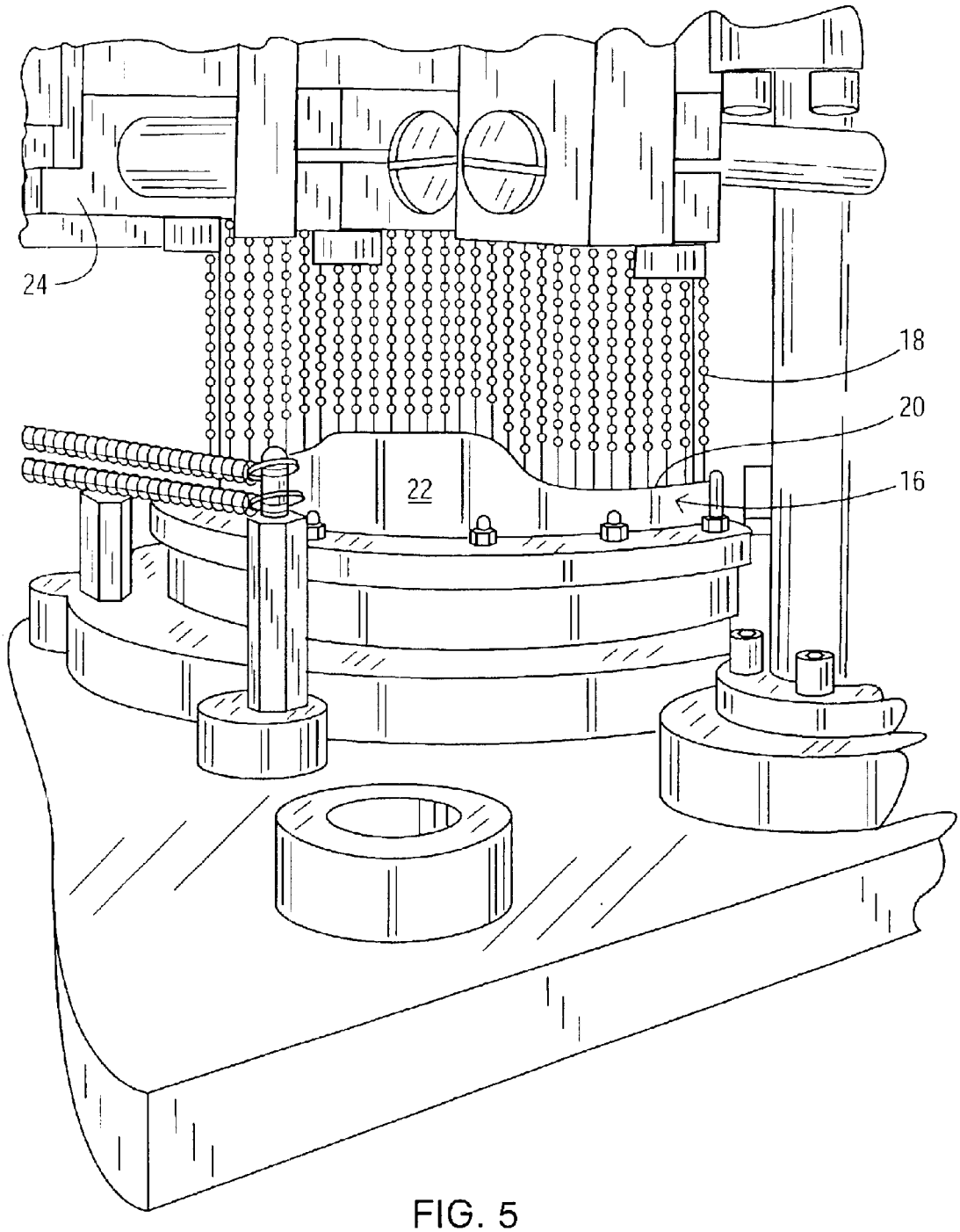
FIG. 5 is an enlarged side elevational view of the reduced cam height shown in FIG. 4 illustrating the raising cam of the present invention.

Referring to FIG. 5, the knitting cylinder 12 also contains means for forming a rib stitch 18. The means for forming a rib stitch 18 may either include a dial or a double cylinder.

In the present invention, the circular knitting machine 10 also contains a means for forming a tuck-stitch 20 with the cylinder needle. In the preferred embodiment, this includes a means for lowering the second feed jack cam 22. Also, in the preferred embodiment, the means for lowering the second feed jack cam 22 is a reduced height cam as depicted in FIG. 5. The jack cam raises just high enough under speed that it may raise too high and lose a stitch, thereby making a hole or "pick-looking" defects. In the preferred embodiment, the top of the jack cam is ground down about 0.090 inches.

The jacks are at the bottom part of the cylinder. They are normally selected on the first feed and what they select on the first feed comes through on the second feed. If the jack goes any higher than tuck, in other words, if it raises high enough that the yarn actually falls off of the latch, then a bad stitch or a hole is formed instead of a tuck stitch.

When it gets to the jack cam, if it is a knitted stitch, then the needle clearing cam is in and when it comes over to the needle clearing cam, the jack cam picks it all the way up and makes a knitted stitch but by pulling that cam out, then a cylinder tuck stitch is made. If the jack cam is not low enough it just makes bad stitches. While the machine could probably run a very tight stitch while leaving the jack cam at a standard height and make a tuck stitch, as cross stretch is increased the stitches pull a lot longer stitch and it will probably shed off of the latches.

Typically, tuck stitches are not made on rib machine. Most rib machines have the needles raised up a little bit higher so the yarn will catch in the needles better. However, in the present invention, the needles are put in on a knitted position and when the yarn is dropped in, the needles are very high when the needles catch the yarn, and just as soon as the needles start pulling that yarn down, then the cam is pulled out and the needles go into a tuck position so that the yarn in under the needles.

The circular knitting machine 10 may further include a fabric separator 24 to prevent the fabric from being snagged by the needles and bunching the fabric. In the preferred embodiment, the fabric separator 24 is an air blast directed at the fabric, which is selectively activated at the appropriate time in the prescribed knitting cycle. The fabric separator 24 may also be accomplished by an increased angle of separation between an empty needle and the stitch formation. This increased angle should be greater than about 20 degrees.

Figure 6:
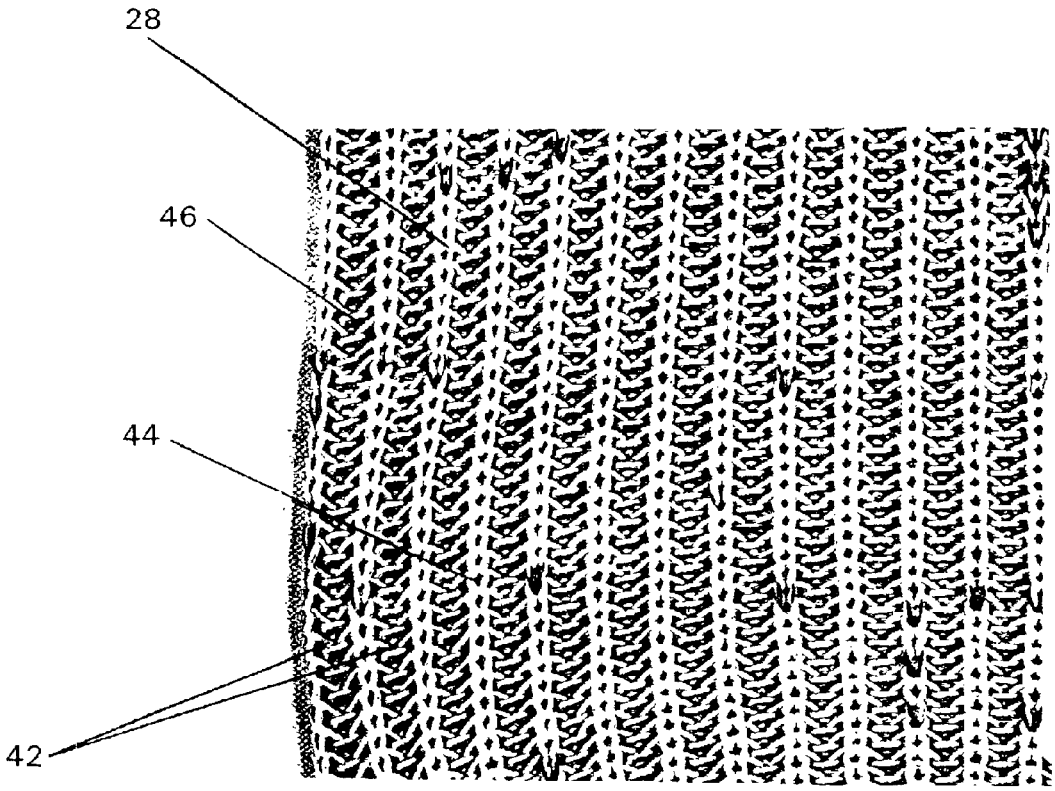
FIG. 6 is cross-sectional view of a knitted tubular article produced by the present invention containing the unique cylinder tuck stitch of the present invention.

In operation, formation of the tuck-stitch 28 on the cylinder needle is made on a single revolution. After the formation of each tuck-stitch 28, the cylinder needle commences another revolution to form the tuck-stitch 28. Thus, according to the present invention, the rib-knit tubular article fabricated includes at least two rib stitches 42 per cylinder stitch 44 and each cylinder section further includes a flat knit section 46. This results in substantially higher cross-stretch since there are 2 rib stitches for each cylinder tuck stitch, as best seen in FIG. 6.

The stitch for the dial and cylinder needles are cleared on the first feed. The second feed clears the stitch on the dial needle but only takes on yarn on the cylinder needle resulting in two courses of yarn. By having two feeds or multiples of two, the cylinder tuck stitch can be formed on the same revolution. If it had four feeds, two tuck stitches, it could be formed on the same revolution. The dial needle is making two courses per revolution but by not shedding the cylinder stitch on the second feed, the cylinder needles are only making one course.

Figure 7:
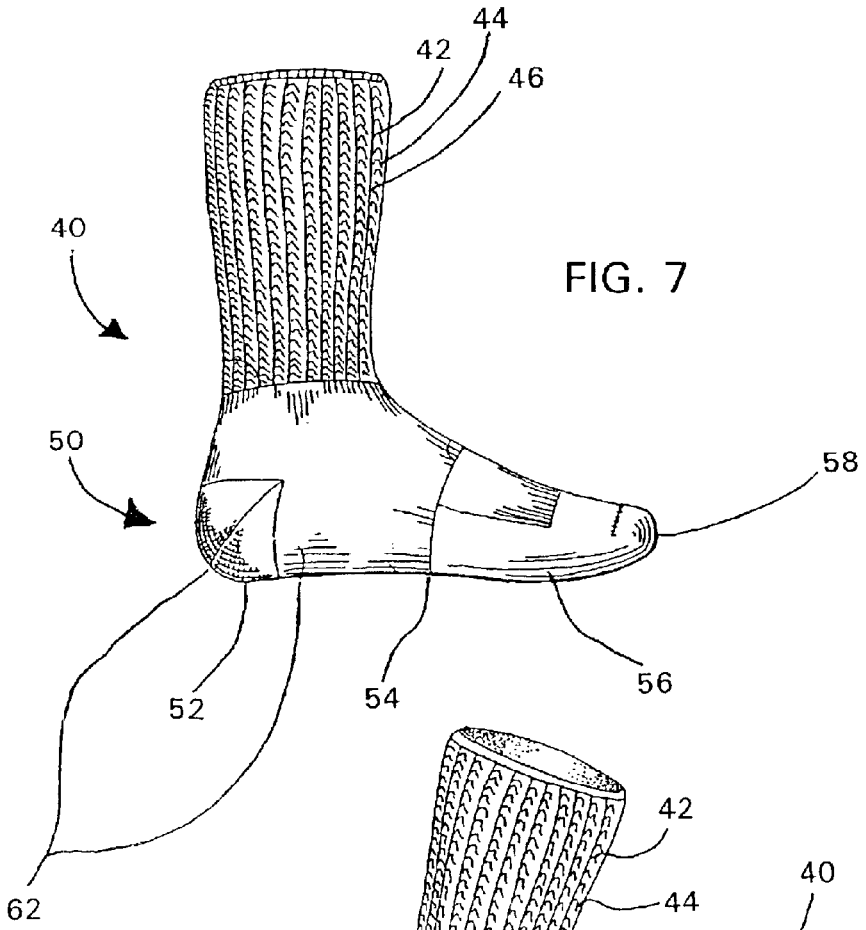
FIG. 7 is a perspective view of the tubular knitted article, namely a sock.
Figure 8:
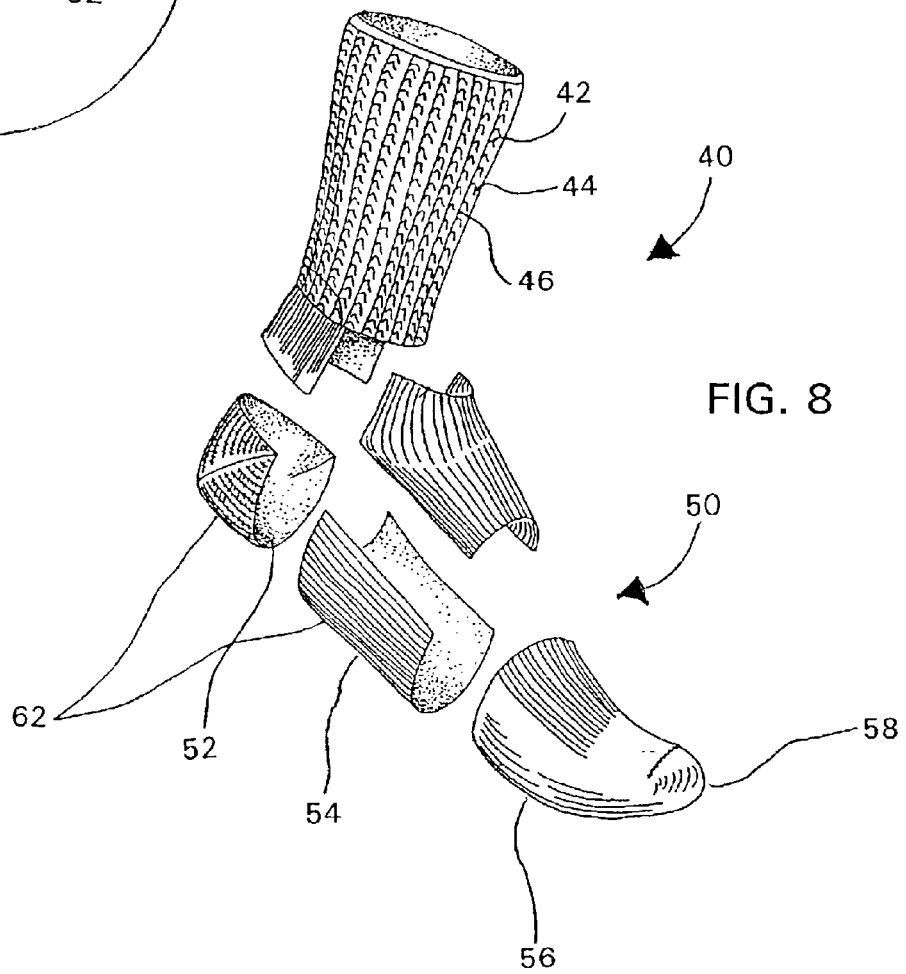
FIG. 8 is a perspective view reflecting the various sections of the tubular knitted sock.

Referring to FIGS. 7 and 8, the rib knit tubular article 40 of the preferred embodiment is depicted. The rib knit tubular article 40 is a sock and is shown with the various sections of the sock 40. The foot 50 of the sock 40 is indicated as well as the heel 52, the instep 54, the sole 56, and the toe 58. The cushion portion 62 of the sock 40 is further depicted in FIG. 8.

In the preferred embodiment, the reduced height cam 22 as shown in FIG. 5 provides the means for forming the cylinder tuck stitch 28. The cylinder tuck stitch 28 is formed by having at least two rib stitches per cylinder stitch 42 and one rib per cylinder stitch 44 combined with the flat knit stitch 46 as depicted in FIG. 6. The combination of this tuck-stitch produces a cross-stretch in the fabric which is greater than 130% of the fabric while at the same time, maintaining a length stretch which is substantially the same as one to one.

A sock produced by the present invention also has a significantly greater "relaxed width" for the same cylinder size, knitting machine. "Relaxed width" is the measurement usually taken of the rib portion of elastic containing socks as a way of measuring the amount of tension in the sock after it has been taken off the knitting machine. For a conventionally knitted rib sock on a 4 inch cylinder machine, the relaxed width would be between about 2½ and 3 inches. However, the relaxed width of a knitted sock according to the present invention would be between about 3 and 4 inches for the same cylinder size. Thus, for the same cylinder size, the relaxed width of the rib portion of a sock produces according to the present invention is greater than between about 120% and 130% than a conventionally knitted sock on the same size cylinder and, preferably, may be greater than about 150%.

Certain modifications and improvements will occur to those skilled in the art upon a reading of the foregoing description. By way of example, older single feed machines could be modified to make the knitted article of the present invention by skipping every other revolution. However, this would be much less efficient than the multiple feed machine of the present invention, which does not have to skip a revolution. Also, while in the preferred embodiment, the second feed jack cam is physically and permanently lowered, it could also be mechanically lowered in some newer machines. It should be understood that all such modifications and improvements have been deleted herein for the sake of conciseness and readability but are properly within the scope of the following claims.

What is claimed is:

1. In a circular knitting machine, said apparatus including: a knitting cylinder; a bed for supporting said knitting cylinder; a plurality of cam blocks; and means for forming a rib stitch, the improvement comprising: means for forming a tuck stitch on the cylinder needle, said means comprising:

(a) means for lowering a second feed jack cam; and (b) a fabric separator including an air blast directed at the fabric for preventing the fabric from snagging on the needles.

2. The apparatus according to claim 1, wherein said means for lowering the second feed jack cam include reduction of the cam height.

3. The apparatus according to claim 1, wherein said air blast is selectively activated.

4. The apparatus according to claim 1, wherein said means for forming a tuck stitch on a cylinder needle is performed in a single revolution for a multiple feed knitting machine.

5. The apparatus according to claim 1, wherein said means for forming a tuck stitch on a cylinder needle includes skipping a revolution before forming a second cylinder stitch for a single feed knitting machine.

6. A circular knitting machine, said apparatus comprising:

(a) a knitting cylinder;

(b) a bed for supporting the knitting cylinder;

(c) a plurality of cam blocks;

(d) means for forming a rib stitch;

(e) means for forming a tuck stitch on the cylinder needle, said means including: (i) means for lowering a second feed jack cam; and (ii) a fabric separator including an air blast directed at the fabric for preventing the fabric from snagging on the needles; and (f) means for selectively disengaging the second feed needle clearing cam.

7. The apparatus according to claim 6, wherein said means for selectively disengaging the second feed needle clearing cam further includes an actuator connected to said second feed needle clearing cam.

8. The apparatus according to claim 7, wherein said actuator includes a rod connected to a drum of said knitting machine.

9. The apparatus according to claim 6, wherein said knitting cylinder further includes at least two feed cams.

10. The apparatus according to claim 9, wherein said feed cams further include additional feed cams in multiples of two.

11. The apparatus according to claim 6, wherein said plurality of cam blocks forms said cylinder tuck stitch.

12. The apparatus according to claim 6, wherein said means for forming said rib stitch is a dial.

13. The apparatus according to claim 6, wherein said means for forming a rib stitch is a double cylinder.

14. The apparatus according to claim 6, wherein said means for lowering the second feed clear cam include reduction of the cam height.

15. The apparatus according to claim 6, wherein said air blast is selectively activated.

16. The apparatus according to claim 6, wherein said means for forming a tuck stitch on a cylinder needle is a single revolution.

17. The apparatus according to claim 6, wherein said means for forming a tuck stitch on a cylinder needle includes skipping a revolution before forming a second cylinder stitch for a single feed knitting machine.

* * * * *